US005797337A

United States Patent [19]

Papajewski et al.

[11] Patent Number: 5,797,337

[45] Date of Patent: Aug. 25, 1998

[54] NEEDLE BAR DRIVE FOR A BUTTONHOLE SEWING MACHINE

[75] Inventors: Rudy Papajewski; Gerd Papajewski, both of Stutensee, Germany

[73] Assignee: AMF Reece, Inc., Mechanicsville, Va.

[21] Appl. No.: 629,408

[22] Filed: Apr. 8, 1996

[51] Int. Cl.[6] ..... D05B 69/00; D05B 3/06

[52] U.S. Cl. ..... 112/221; 112/65

[58] Field of Search ..... 112/221, 65, 157, 112/443, 284

[56] References Cited

U.S. PATENT DOCUMENTS

| | | | |
|---|---|---|---|
| 1,771,670 | 7/1930 | Carlson . | |
| 2,250,696 | 7/1941 | Avis . | |
| 3,450,081 | 6/1969 | Rabinow | 112/221 |
| 4,369,721 | 1/1983 | Bolldorf et al. . | |
| 4,441,441 | 4/1984 | Bianchi . | |
| 4,452,157 | 6/1984 | Cantada et al. | 112/221 |
| 4,569,297 | 2/1986 | Dusch . | |
| 4,616,585 | 10/1986 | Marcandalli . | |
| 4,967,677 | 11/1990 | Seiriki et al. . | |
| 4,981,093 | 1/1991 | Schopf | 112/221 |
| 5,507,239 | 4/1996 | Fujii et al. | 112/221 X |

*Primary Examiner*—Paul C. Lewis
*Attorney, Agent, or Firm*—James Creighton Wray

[57] ABSTRACT

A counter-weighted eccentric or crank is clamped to an end of the upper drive shaft. A link is pivoted between the eccentric and an end of a short leg on a V-shaped rocker. The base of the V-shaped rocker is pivoted on a fixed pin. The long arm of the V-shaped rocker is connected to a needle bar to drive the needle bar up and down. The movement of the needle bar carries a main needle and thread through a workpiece to make stitches in the cloth.

10 Claims, 5 Drawing Sheets

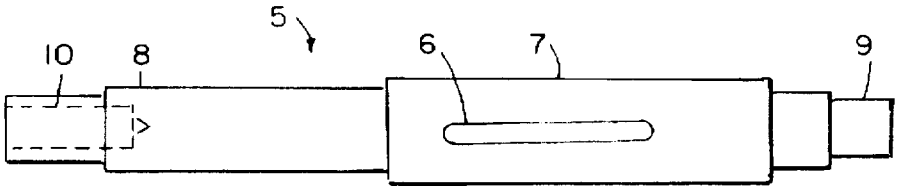
FIG. 5
FIG. 6
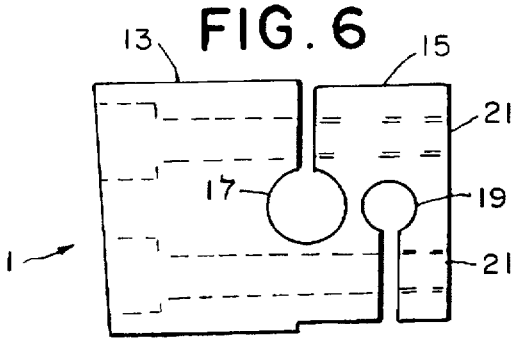
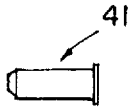
FIG. 9
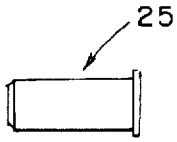
FIG. 10
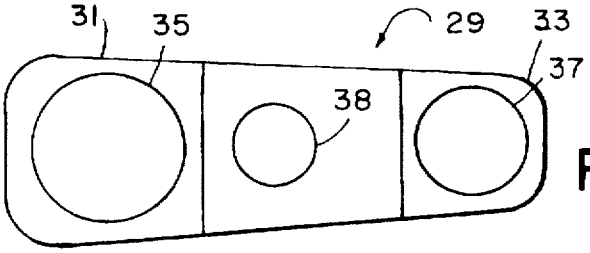
FIG. 7
FIG. 8
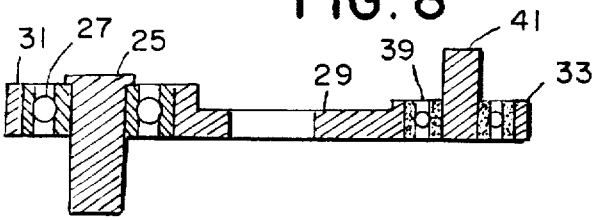
FIG. 11
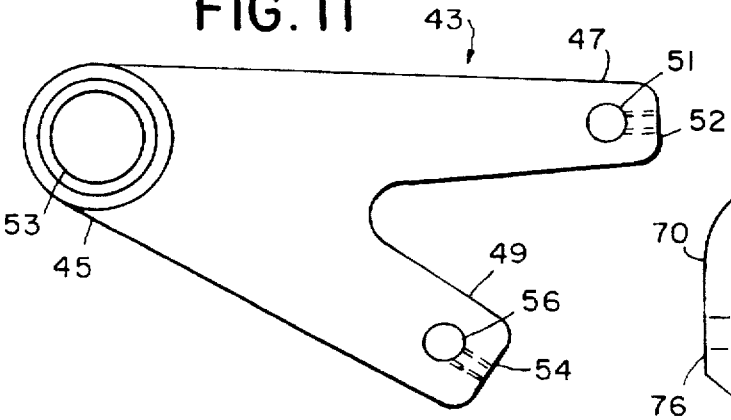
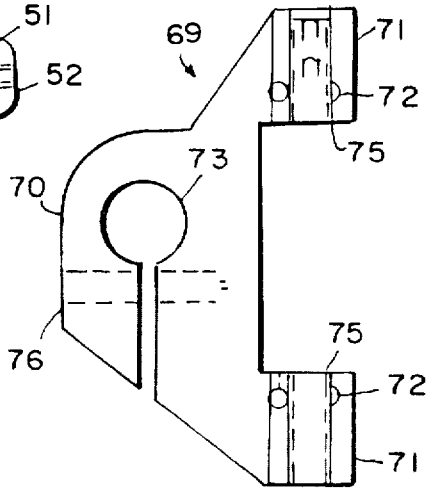
FIG. 13

NEEDLE BAR DRIVE FOR A BUTTONHOLE SEWING MACHINE

BACKGROUND OF THE INVENTION

The present invention relates to an improved needle bar drive used to facilitate stitching in sewing machines to make buttonholes. Specifically, this invention allows the main needle, bearing the thread, to move upward and downward through a workpiece to create stitches.

A strength of the present invention is the use of a rocker to transfer the motion of an eccentric to an upward and downward motion of the sewing needle. The rocker is pivoted about a stationary point and provides extra stability to the mechanism. The extra stability helps reduce vibrations in the needle bar drive mechanism and reduces vibration in the sewing machine in general.

Another strength is the use of two connecting links to allow a separate bight motion to be applied to the needle bar assembly to create bight stitches. The separate bight motion swings the needle bar assembly back and forth to create the stitches along the sides of a buttonhole. This bight motion cannot interfere with the upward and downward motion of the main needle in creating a stitch. The double linkage allows this motion to be coupled into the upward and downward motion of the main needle without interference.

The prior art does not demonstrate the same stability as the present needle bar drive mechanism. While many previous inventions allow for proper stitching to occur with the main needle, the greater stability and simplicity of coupling other motions with the main sewing motion are not found in these inventions.

SUMMARY OF THE INVENTION

An objective of the present invention is to remedy the disadvantages of the prior art by providing a reliable apparatus that allows users to form buttonholes in garments. A counter-weighted eccentric or crank is clamped to an end of an upper drive shaft. A link is pivoted between the eccentric and an end of a short leg on a V-shaped rocker. The base of the V-shaped rocker is pivoted on a fixed pin. The long arm of the V-shaped rocker is connected to a needle bar to drive the needle bar up and down. The movement of the needle bar carries a main needle and thread through a workpiece to make stitches in the cloth.

In a preferred embodiment, a needle bar drive for a button hole sewing machine has a drive shaft connected with a crank having a counter-weighted side. A smaller side of the crank is connected to a smaller end of a crank link. A larger end of the crank link is connected to a crank leg of a V-shaped rocker. The rocker pivots on a fixed pin through a first opening in the base of the rocker. Another leg of the rocker is connected to a middle section of a needle bar that also has a needle end. A main needle, connected to the needle holder at the needle end, carries thread through a workpiece in creating stitches.

The embodiment also has a needle bar holder which receives the needle bar and allows the needle bar to move upward and downward. The holder has an oblong end and two smaller block-like ends forking off the oblong end. The oblong side has a large opening passing through it. A bight shaft passes through and connects to the large opening to support the needle bar holder and to allow for bight stitches to be made. The block-like ends both have passages which run transverse to the large opening and lie along the same axis. These two passages in the block-like ends accommodate the needle bar and allow it to slide through the passages.

The preferred embodiment also has a needle bar clamp that clamps onto the needle bar. A needle leg of the rocker is pivotally connected to a cylindrical section of the needle bar clamp and communicates the rocking of the rocker into an upward and downward motion of the needle bar. Two needle bar guide rails are attached to the needle bar holder at the block-like ends. The rails have a separation to allow a slat of the needle bar clamp to pass through and guide the motion of the needle bar clamp and needle bar.

Additionally, a connecting link pivotally connects to the cylindrical section of the needle bar clamp and pivotally connects to the needle leg of the rocker. This additional linkage is important to allow the needle bar assembly to rock along with the rocking of the bight shaft.

Also, two flanged bushings are inserted at each end of the first opening of the rocker to facilitate the rocking of the rocker on the fixed pin. Rings of ball bearings connected to clevis pins aid in creating the pivotal connection between the crank and the crank link and the pivotal connection between the crank link and the rocker.

These and further and other objects and features of the invention are apparent in the disclosure, which includes the above and ongoing written specification, with the claims and drawings.

BRIEF DESCRIPTION OF THE DRAWINGS

FIG. 4A shows the down position, FIG. 4B shows the mid left position, FIG. 4C shows the up position and FIG. 4D show the mid right position.

FIG. 5 shows a drive shaft.

FIG. 6 shows a crank.

FIG. 7 shows a crank link.

FIG. 8 shows the crank link of FIG. 7 assembled with upper and lower clevis pins.

FIG. 9 shows a lower clevis pin.

FIG. 10 shows an upper clevis pin.

FIG. 11 shows a V-shaped rocker.

FIG. 13 shows a needle bar.

DETAILED DESCRIPTION OF THE DRAWINGS

Figure 1:
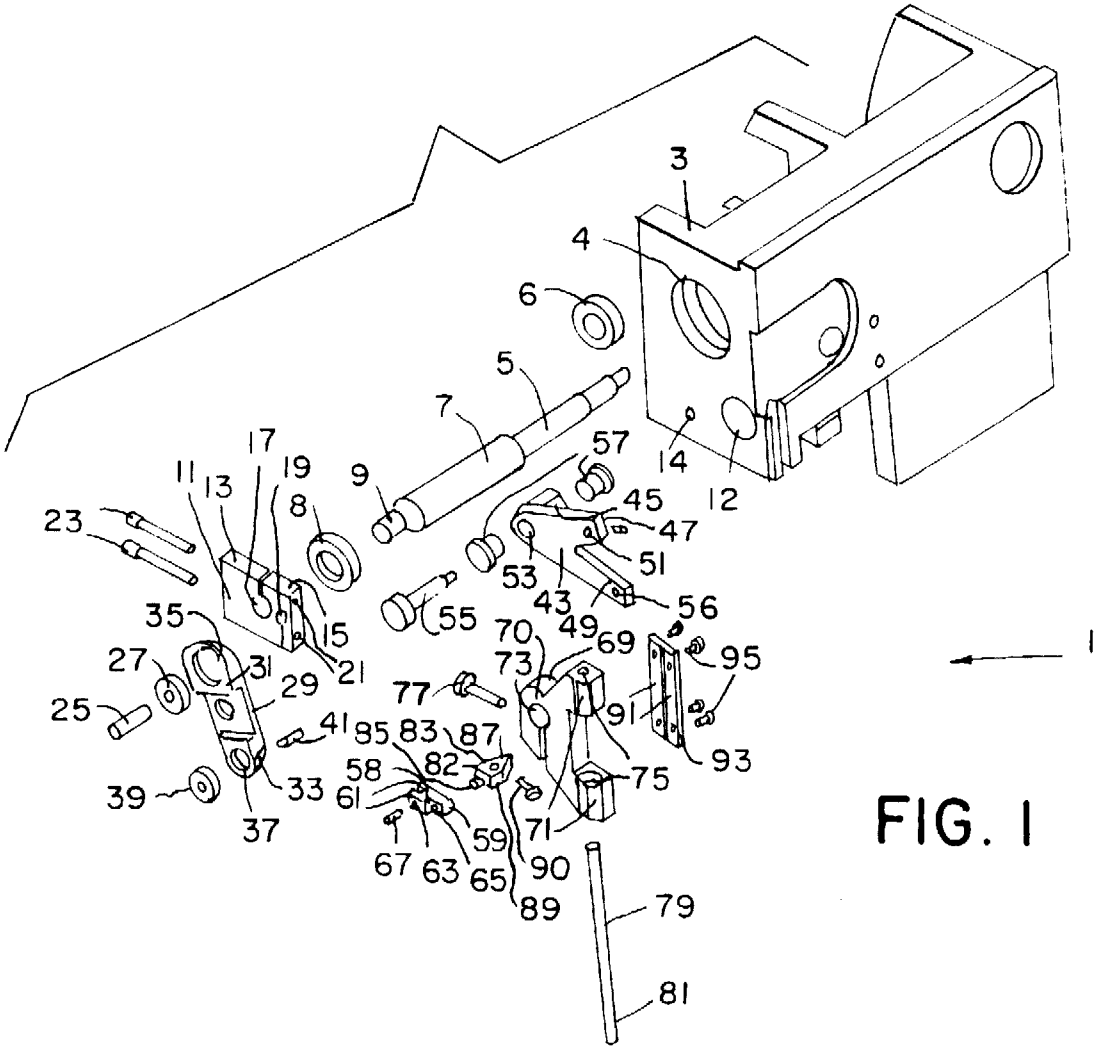
FIG. 1 shows an exploded view of the needle bar drive mechanism.

Referring to FIG. 1, a needle bar drive 1 has a drive housing 3, a bight shaft opening 12, and a drive shaft opening 4. A driving means in the drive housing turns the drive shaft 5 at a middle section 7. The drive shaft 5 has a crank end 9 which is connected to a crank 11 through a large aperture 17 in a counter-weighted side 13. A smaller side 15 of the crank 11 has a smaller aperture 19 through which an upper clevis pin 25 passes. Long screws 23 pass through holes 21 to clamp the crank 11 to the drive end 9 of the drive shaft 5 and the upper clevis pin 25. A first large ball bearing ring 6 secures the drive shaft 5 in the drive shaft opening 4. A second large ball bearing ring 8 is connected to the crank end 9 of the drive shaft 5.

The upper clevis pin 25 passes through an upper ball bearing ring 27 which is connected to a crank link 29 at a larger hole 35 in a first end 31. A lower clevis pin 41 passes though a lower ball bearing ring 39 which is connected to a smaller hole 37 in the second end 33. The lower clevis pin 39 also passes through a second opening 51 in a crank leg 47 of a V-shaped rocker 43. The rocker 43 pivots on a fixed pin 55 which passes through one of a pair of bushings 57, through a first opening 53 of a base 45 of the rocker 43, passes through the second of the bushings 57 and into an opening 14 of the drive housing 3.

A needle leg 49 of the rocker 43 has a third opening 56 which is straddled by forked ends 61 of a connecting link 58. A connecting link pin 67 passes through a second hole 63 in one of the forked ends 61, the third opening 56 of the rocker 43, and a third hole 63 in the other forked end 61.

A cylindrical section 85 of a needle bar clamp 82 passes through a first hole 65 in a rounded end 59 of a connecting link 58. A needle bar 79 is clamped in a block section of the needle bar clamp 82 through a center orifice 83 and the clamping maintained with a screw 90 screwed into the needle bar clamp through a small hole 89. A slat section 87 of the needle bar clamp passes between two needle bar guides 91. The guides are attached to a needle bar holder 69 through small holes 93 in the guides using screws 95.

The needle bar holder has an oblong side 70 and two smaller block-like ends 71. The oblong side 70 has a large opening 73 used to hold a bight shaft 24 using a screw 77 to clamp them together. The block-like ends 71 have passages 75 passing through them to allow the needle bar 79 to pass through. The needle bar 79 has a needle end 81 with a main needle attached that pierces a work piece to make stitches.

In operation, the drive shaft 5 turns and rotates the crank 11 which pushes and pulls on the crank link 29. This pushing and pulling rocks the crank leg 47 of the V-shaped rocker 43, which pivots on the fixed pin 55. The rocking of the rocker 43 moves the connecting link 58 upward and downward.

The upward and downward motion of the connecting link 58 moves the needle bar clamp 82 upward and downward along with the needle bar 79. The clamp is guided in its motion by the needle bar guide rails 91 and the needle bar 79 passes through passages 75 in the needle bar holder 69.

The needle bar holder 69 allows a needle to move up and down through the workpiece creating stitches. The needle bar holder 69 is also moved by a bight shaft 24 passing through the large opening 73, which rotates back and forth. The back and forth motion creates a bight pattern to the stitching made on the workpiece.

Figure 2:
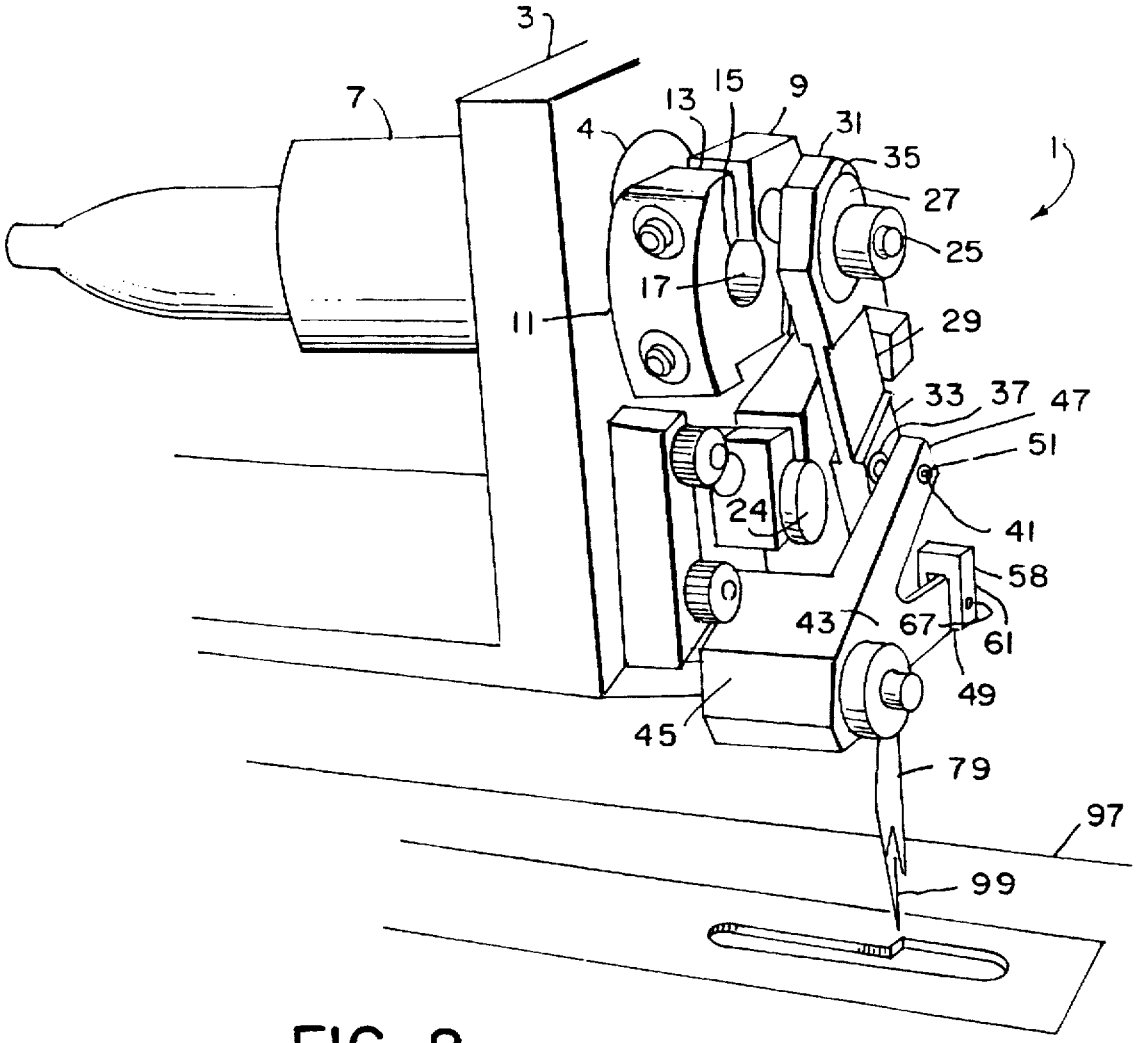
FIG. 2 shows the needle bar drive of FIG. 1 mounted in a button hole sewing machine.

Referring to FIG. 2, the needle bar drive mechanism 1 of FIG. 1 is shown configured in a buttonhole sewing machine. The drive housing 3 supports the drive shaft passing through the drive shaft opening 4. Rotation of the drive shaft is applied by a belt at the middle section 7 and rotates the crank end 9 of the drive shaft. The crank 11 has a counter-weighted side 13 and a smaller side 15 and is connected to the drive shaft at the large aperture 17.

The crank link 29 is connected to the crank 11 at the first end 31 at the larger hole 35. The upper clevis pin 25 passes through the upper ball bearing ring 27 and makes the connection to the crank. The second end 33 of the link 29 pivots around the lower clevis pin 41 through the lower ball bearing ring 39 fixed to the second hole 37 of the crank link 29 and about the second opening on the crank leg 47 of the V-shaped rocker 43.

The needle leg 49 of the rocker 43 pivotally connects to connecting link 58 through a connecting link pin 67 which passes through the forked ends 61 and the needle leg 49.

Also, in FIG. 2, the needle bar 79 and the main needle 99 are shown just above the base 97 of the buttonhole sewing machine.

Figure 3:
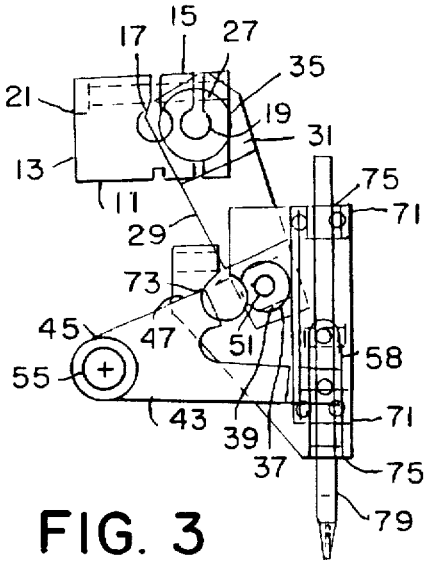
FIG. 3 shows the needle bar drive in an assembled view.
Figure 4A:
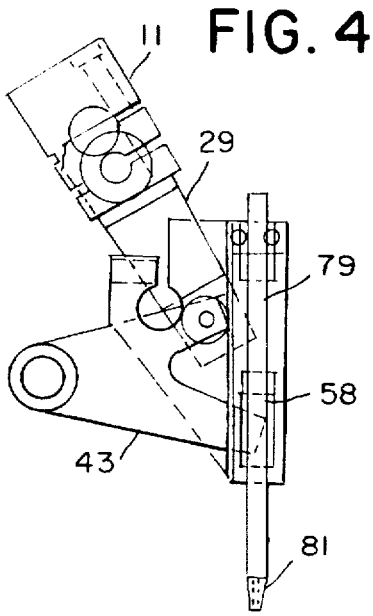
FIGS. 4A–4D show the motion of the parts of the needle bar drive as the needle moves from the down position to the up position.
Figure 4B:
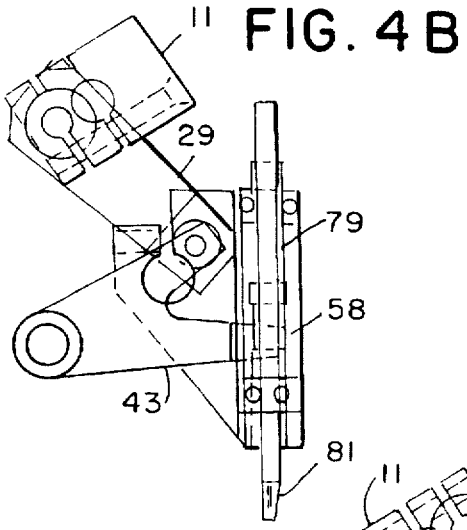
Figure 4C:
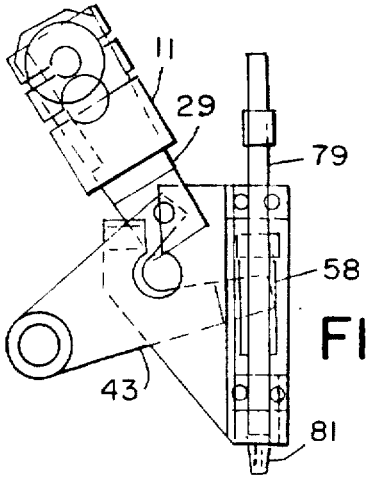
Figure 4D:
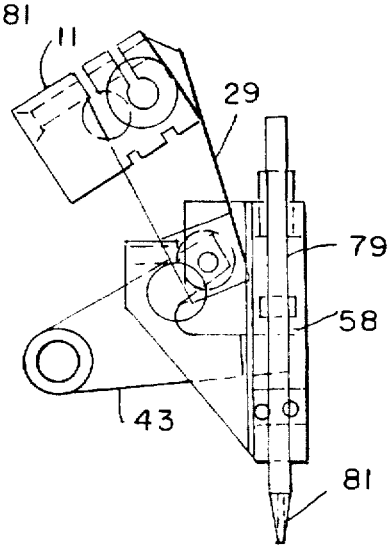

In FIG. 3, an assembled needle drive mechanism is presented. A drive shaft is connected to a crank 11 at a larger aperture 17. The crank is connected to a crank link 29 at a smaller aperture 19. A V-shaped rocker 43 is connected to the crank link at a smaller hole 4, of the crank link. The rocker pivots on a fixed pin 55 about the base 45 of the rocker.

The rocker connects to a connecting link 58 which is attached to a needle bar clamp 82 which is connected to a needle bar 79. The needle bar passes through passages 75 in block-like ends 71 of a needle bar holder 69. The needle bar holder has a large opening 73 where a bight shaft 24 connects to wherein the needle bar holder can rock and thus create bight stitches in the workpiece.

FIG. 4 shows four cyclic positions of a needle bar drive as it is making stitches: a down position, a mid left position, an up position, and a mid right position. A drive shaft spins a crank 11 in complete revolutions. Because a link 29 is connected to the crank off the crank's axis of rotation, the motion of the crank causes the link to be pulled up and to the left between the up and down positions and then down and to the right between the down and up positions. A rocker 43 pivots upward between the up and down positions. A connecting link 58 communicates the motion of the rocker to a needle bar 79, which moves correspondingly upward and downward.

In FIG. 5, a drive shaft 5 has a crank end 9 to connect with a crank and an orifice 10 at the other end 8 to mount the shaft for rotation. Rotation of the shaft is supplied to the shaft through a belt to a center section 7 of the shaft. A keyway 6 cut into the shaft is also shown.

In FIG. 6, a crank 11 has a large aperture 17 and a smaller aperture 19 and transverse countersunk holes 21 to clamp a drive shaft 5 in the large aperture and to clamp a clevis pin 25 in the smaller aperture.

In FIG. 7, a crank link 29 has a first end 31 with a larger hole 35 and a second end 33 with a smaller hole 37. A mass-reducing hole 38 is also shown.

In FIG. 8, a crank link 29 is shown assembled with upper 25 and lower 41 clevis pins and ball bearing rings 27, 39.

In FIG. 9, a lower clevis pin 41 is detailed.

In FIG. 10, an upper clevis pin 25 is detailed.

In FIG. 11, a V-shaped rocker 43 has an extended base 45 with a first opening 53, a crank leg 47 with a second opening 51 and a needle leg 49 with a third opening 53. In addition, each leg has another hole 52, 54 to accept set screws.

Figure 12:
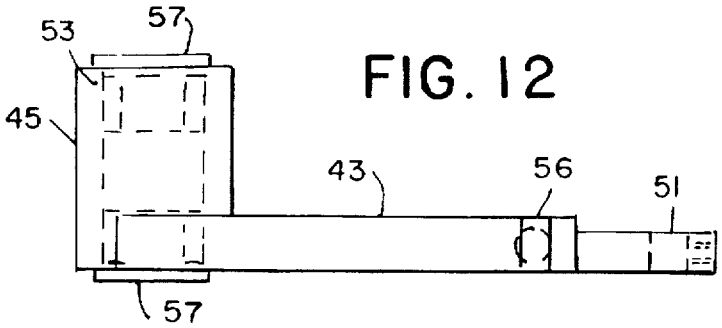
FIG. 12 shows the V-shaped rocker assembled with bushings.

In FIG. 12, a V-shaped rocker 43 is shown assembled with bushings 57 installed at both ends of a first hole 53 that passes through a base 45 of the rocker.

In FIG. 13, a needle bar holder 69 has an oblong end 70 with a large opening 73 through the end and an orifice 76 transverse to the large opening for clamping a bight shaft 24 in the large opening, and two block-like ends 71, each having a passage 75 passing through the block-like ends. Holes 72 for connecting needle bar guide rails to the needle bar holder are shown.

Figure 14:
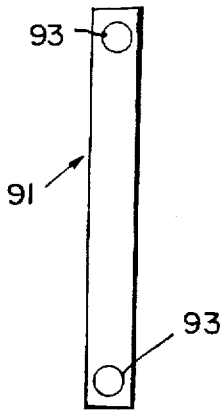
FIG. 14 shows a needle bar holder.

In FIG. 14, a needle bar guide rail 91 has upper and lower ends, with each end having a small hole 93.

Figure 15:
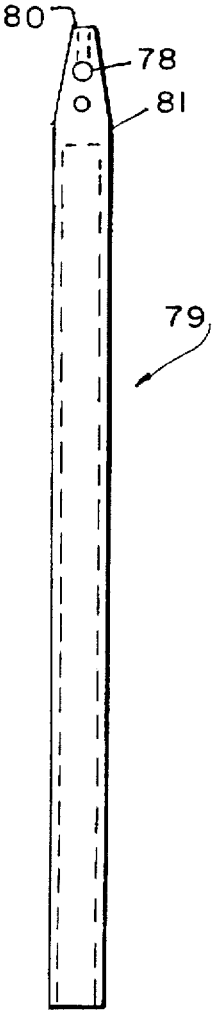
FIG. 15 shows a needle bar clamp.

FIG. 15 shows a needle bar 79 with a notch 80 and a hole 78 for a set screw in a needle end 81 of the bar.

Figure 16:
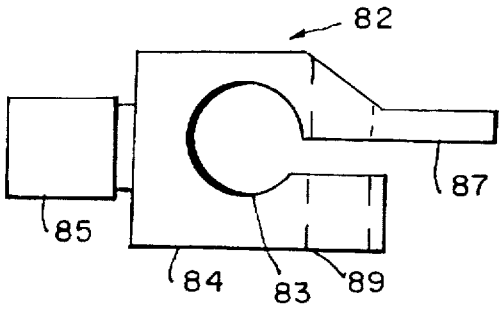
FIG. 16 shows a needle bar guide rail.

In FIG. 16, a needle bar clamp 82 has a cylindrical section 85, a block section 84 with a center orifice 83 and a hole 89 transverse to the center orifice for clamping a needle bar, and a slat section 87.

Figure 17:
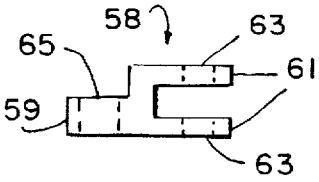
FIG. 17 shows a connecting link.

In FIG. 17, a Y-shaped connecting link 58 has a rounded end 59 with a first hole 65 through the end and two forked ends 61 with second and third holes 63 through the respective forked ends.

Figure 18:
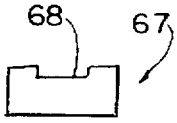
FIG. 18 shows a connecting link pin.

In FIG. 18, a connecting link pin 67 has a recessed center region 68 to limit the complete rotation of the pieces it joins.

While the invention has been described with reference to specific embodiments, modifications and variations of the invention may be construed without departing from the scope of the invention, which is defined in the following claims.

We claim:

1. A needle bar drive for a button hole sewing machine comprising a driving means, a drive shaft connected to the driving means, having a drive section and a crank end, a crank with a counter-weighted side and a smaller side, where the counter-weighted side has a large aperture passing through it and the smaller side has a smaller aperture passing through, and the drive shaft is connected to the crank with the crank end of the drive shaft passing through the large aperture, a crank link having a first end and a second end, where the crank is connected, through the smaller aperture of the crank to the first end of the crank link through a larger hole in the first end of the crank link, a fixed pin, a V-shaped rocker having a base, a crank leg, and a needle leg, where the rocker pivots on the fixed pin through a first opening in the base of the rocker, and the rocker is pivotally connected through a second opening in the crank leg to a smaller hole in the second end of the crank link, a needle bar with a needle end and a middle section, where the middle section is pivotally connected to the rocker through a third opening in the needle leg of the rocker, and a main needle, connected to the needle holder at the needle end, where the main needle carries thread through a workpiece in creating stitches.

2. The apparatus of claim 1, further comprising a needle bar holder with an oblong end and two smaller block-like ends forking off of the oblong end, where the oblong side has a large opening passing through it and the block-like ends both have passages which run transverse to the large opening and lie along the same axis, and where the two passages in the block-like ends can accommodate and allow to slide the needle bar through the passages, and a bight shaft which passes through and connects to the large opening to support the needle bar holder.

3. The apparatus of claim 2, further comprising a needle bar clamp with a cylindrical section, a block section with a center orifice and a slat section, where the needle bar passes through and is connected to the center orifice and the needle leg of the rocker is pivotally connected to the cylindrical section of the needle bar clamp, and two needle bar guide rails each having an upper and lower end and each end having a small hole passing through the end, attached to the needle bar holder at the block-like ends through the small holes and each rail running parallel to the axis of the passages in the block-like ends, and where the rails have a separation to allow the slat of the needle bar clamp to pass through and guide the motion of the needle bar clamp and needle bar.

4. The apparatus of claim 4, further comprising a connecting link having a rounded end and forked ends where the rounded end has a first hole passing through the link and the forked end has second and third holes, with the second hole passing through a first forked end and the third hole passing through the second forked end, where both holes share a common center axis which is parallel to the first hole, where the cylindrical section of the needle bar clamp passes into and connects to the first hole of the connecting link and the forked ends straddle the needle leg of the rocker at the third opening, and a connecting link pin passes through the second and third holes of the connecting link and the third opening of the rocker to provide a pivotal connection.

5. The apparatus of claim 1, wherein the base of the rocker extends from a plane formed by the base and the crank leg and the needle leg, further comprising two flanged bushings inserted at each end of the first opening to facilitate the rocking of the rocker on the fixed pin.

6. The apparatus of claim 1, further comprising an upper radial ball bearing ring, a lower radial ball bearing ring, an upper clevis pin and a lower clevis pin, where the upper clevis pin passes through the upper ring and the lower clevis pin passes through the lower ring, wherein the upper clevis pin provides the pivotal connection between the crank and the crank link by passing through the smaller hole of the crank and the upper ring connecting to the crank link at the larger hole, and wherein the lower clevis pin provides the pivotal connection between the crank link and the rocker by passing through the second opening of the rocker and the lower ring connecting to the crank link at the smaller hole.

7. The apparatus of claim 1, wherein the crank has two clamping apertures passing through the crank from the counter-weighted side to the smaller side, and two long clamping screws which pass through the clamping apertures clamping the drive in the large aperture and clamping the pivotal connection to the crank link in the smaller aperture.

8. A method of driving a needle in a buttonhole sewing machine comprising the steps of turning a drive shaft, connecting a crank to a drive end of the drive shaft, connecting a first end of a crank link to the crank, pulling and pushing the first end of the crank link, connecting a second end of the crank link to a first leg of a V-shaped rocker for constraining a motion of the crank link by pushing and pulling the first leg and by rocking the rocker up and down, pivotably connecting the rocker on a fixed pin, connecting a second leg of the rocker to a needle bar and making the needle bar move upward and downward, connecting a main needle to the needle bar, wherein the upward and downward motion of the needle bar causes the needle to pass through a workpiece creating stitches.

9. The method of claim 8, further comprising pivotally connecting a first end of a connecting link to the second leg of the rocker for rocking the rocker and causing the connecting link to pivot back and forth, pivotally connecting a second end of the connecting link to a needle bar clamp for moving the needle bar clamp upward and downward, clamping the needle bar clamp onto a needle bar for moving the needle bar upward and downward, providing the needle bar freely within a needle bar holder and constraining a motion of the needle bar to only upward and downward motion relative to the needle holder, providing spaced needle bar guide rails on the needle bar holder running parallel to the needle bar, accommodating a slat section of the needle bar clamp along the guide rails for guiding motions of the needle bar clamp, the needle bar and the main needle.

10. The method of claim 9, further comprising connecting a bight shaft to the needle bar holder transverse to the motion of the needle bar and the main needle, rotating the bight shaft for rocking the needle holder and thereby rocking the needle bar, and creating a bight pattern on the workpiece by rocking the needle bar and moving the main needle upward and downward.

* * * * *